US010065423B2

(12) United States Patent
Takagi et al.

(10) Patent No.: US 10,065,423 B2
(45) Date of Patent: Sep. 4, 2018

(54) LIQUID DISCHARGE DEVICE, LIQUID DISCHARGE CONTROL METHOD, AND RECORDING MEDIUM

(71) Applicants: Yasunobu Takagi, Kanagawa (JP); Kaoru Sakamoto, Tokyo (JP); Yoichi Ito, Tokyo (JP)

(72) Inventors: Yasunobu Takagi, Kanagawa (JP); Kaoru Sakamoto, Tokyo (JP); Yoichi Ito, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 78 days.

(21) Appl. No.: 15/368,897

(22) Filed: Dec. 5, 2016

(65) Prior Publication Data

US 2017/0173952 A1 Jun. 22, 2017

(30) Foreign Application Priority Data

Dec. 17, 2015 (JP) ..... 2015-246441

(51) Int. Cl.
*B41J 2/14* (2006.01)
*B41J 25/00* (2006.01)

(52) U.S. Cl.
CPC ..... *B41J 2/1433* (2013.01); *B41J 25/005* (2013.01)

(58) Field of Classification Search
CPC . B41J 29/38; B41J 29/393; B41J 11/42; B41J 2/2135; B41J 13/0009; B41J 19/202; B41J 2/04573; B41J 2/04501; B41J 2/1433; B41J 11/0095
USPC ... 347/5, 9, 12, 14, 16, 19, 37, 47, 101, 104
See application file for complete search history.

(56) References Cited

U.S. PATENT DOCUMENTS

2010/0207982 A1* 8/2010 Satoh ..... B41J 2/155 347/14

FOREIGN PATENT DOCUMENTS

| | | |
|---|---|---|
| JP | 10-315541 | 12/1998 |
| JP | 2001-219549 | 8/2001 |
| JP | 2004-338215 | 12/2004 |

* cited by examiner

*Primary Examiner* — Jannelle M Lebron
(74) *Attorney, Agent, or Firm* — Harness, Dickey & Pierce, P.L.C.

(57) ABSTRACT

A liquid discharge device includes: a liquid discharge head; a nozzle array disposed on the head in a conveyance direction; a movement driver that moves the head to discharge liquid from the nozzle array in a direction perpendicular to the conveyance direction in a reciprocating manner; a discharge driver that causes the head to discharge the liquid; a conveyor that conveys an object; and a controller that acquires an amount of conveyance of the object by the conveyor over a period during which the head moves from a predetermined position to a position where the head is to discharge the liquid to a target pixel, and determines, on which reciprocating travelling of the head to discharge the liquid and from which nozzle in the nozzle array to discharge the liquid, based on the amount of conveyance.

20 Claims, 8 Drawing Sheets

LIQUID DISCHARGE DEVICE, LIQUID DISCHARGE CONTROL METHOD, AND RECORDING MEDIUM

CROSS-REFERENCE TO RELATED APPLICATION

This patent application is based on and claims priority pursuant to 35 U.S.C. § 119(a) to Japanese Patent Application No. 2015-246441, filed on Dec. 17, 2015, in the Japan Patent Office, the entire disclosure of which is hereby incorporated by reference herein.

BACKGROUND

Technical Field

The present invention relates to a liquid discharge device, a liquid discharge control method, and a non-transitory recording medium.

Description of the Related Art

Liquid discharge devices that discharge liquid on an object while conveying the object and operating a liquid discharge head that discharges the liquid in a reciprocating manner in a direction perpendicular to a conveyance direction of the object are known.

As liquid discharge devices, image-forming devices such as printers, facsimiles, copying devices, and multifunction peripheral of these are known. As the image-forming devices, image-forming devices of an inkjet type (inkjet recording device) are known. The image-forming devices of an inkjet type form an image (terms including recording, printing, printing photography, and printing letters also represent the same meaning) by causing ink (recording liquid) as the liquid to adhere to a recording medium (hereinafter also referred to as "paper" but this does not limit a material thereof) using a device including a liquid discharge head while conveying the recording medium.

In the inkjet recording medium, an image is formed by discharging ink with a carriage including the liquid discharge head (recording head) operated in a reciprocating manner in a main-scanning direction (hereinafter referred to as head moving direction) while a recording medium is sequentially conveyed in a sub-scanning direction (hereinafter referred to as paper conveyance direction). Such serial type inkjet recording devices are widely used mainly in households, SOHOs, stores, or the like.

Such serial type inkjet recording devices do not require a fixing mechanism and thus are relatively quiet and achieve a low cost with a small size as compared to electrophotographic image-forming devices. Leveraging these characteristics, the serial type inkjet recording devices are often installed in a relatively small space with people coming and going, such as households, SOHOs, stores, or the like. Therefore, suppressing noise accompanied by operation of the device is one of problems.

There are several reasons for occurrence of noise. Major reasons include conveyance of a recording medium. In the serial type inkjet recording device, usually a paper is fed from a paper-feeding tray by a conveyance mechanism and is caused to pause in an operation region of the liquid discharge head. In this state, the liquid discharge head is operated in the main-scanning direction in a reciprocating manner and thereby discharges ink on the paper to form an image.

Here, conveyance operation and pausing of the paper is repeated. In particular, when operation is accelerated or decelerated such as when a paper is pulled in, operation sound of the conveyance mechanism becomes loud, thereby causing unwanted noise.

The operation sound occurring upon acceleration or deceleration may be mitigated by reducing the conveyance speed of a paper; however, when the conveyance speed of a paper is reduced, a printing speed drops and thus productivity drops.

Meanwhile, proposed is a serial type inkjet recording device that forms an image in an oblique direction without halting conveyance of a paper even during printing by the liquid discharge head travelling in a reciprocating manner. This is called oblique printing. According to oblique printing, operation sound can be mitigated without reducing productivity as compared to the case of intermittent operation a paper as in the related art.

SUMMARY

Example embodiments of the present invention include a liquid discharge device, including: a liquid discharge head; a nozzle array disposed on the head in a conveyance direction in which an object is conveyed; a movement driver that moves the head to discharge liquid from the nozzle array in a direction perpendicular to the conveyance direction in a reciprocating manner; a discharge driver that causes the head to discharge the liquid while the movement driver moves the head; a conveyor that conveys the object while the movement driver moves the head; and a controller that controls discharge of the liquid to a target pixel. The controller acquires an amount of conveyance of the object by the conveyor over a period during which the head moves from a predetermined position to a position where the head is to discharge the liquid to a target pixel, and determines, on which reciprocating travelling of the head to discharge the liquid to the target pixel, and from which nozzle in the nozzle array to discharge the liquid to the target pixel, based on the amount of conveyance.

Example embodiments of the present invention include a liquid discharge control method, performed by the liquid discharge device, and a non-transitory recording medium storing a control program for causing a processor to perform the liquid discharge control method.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
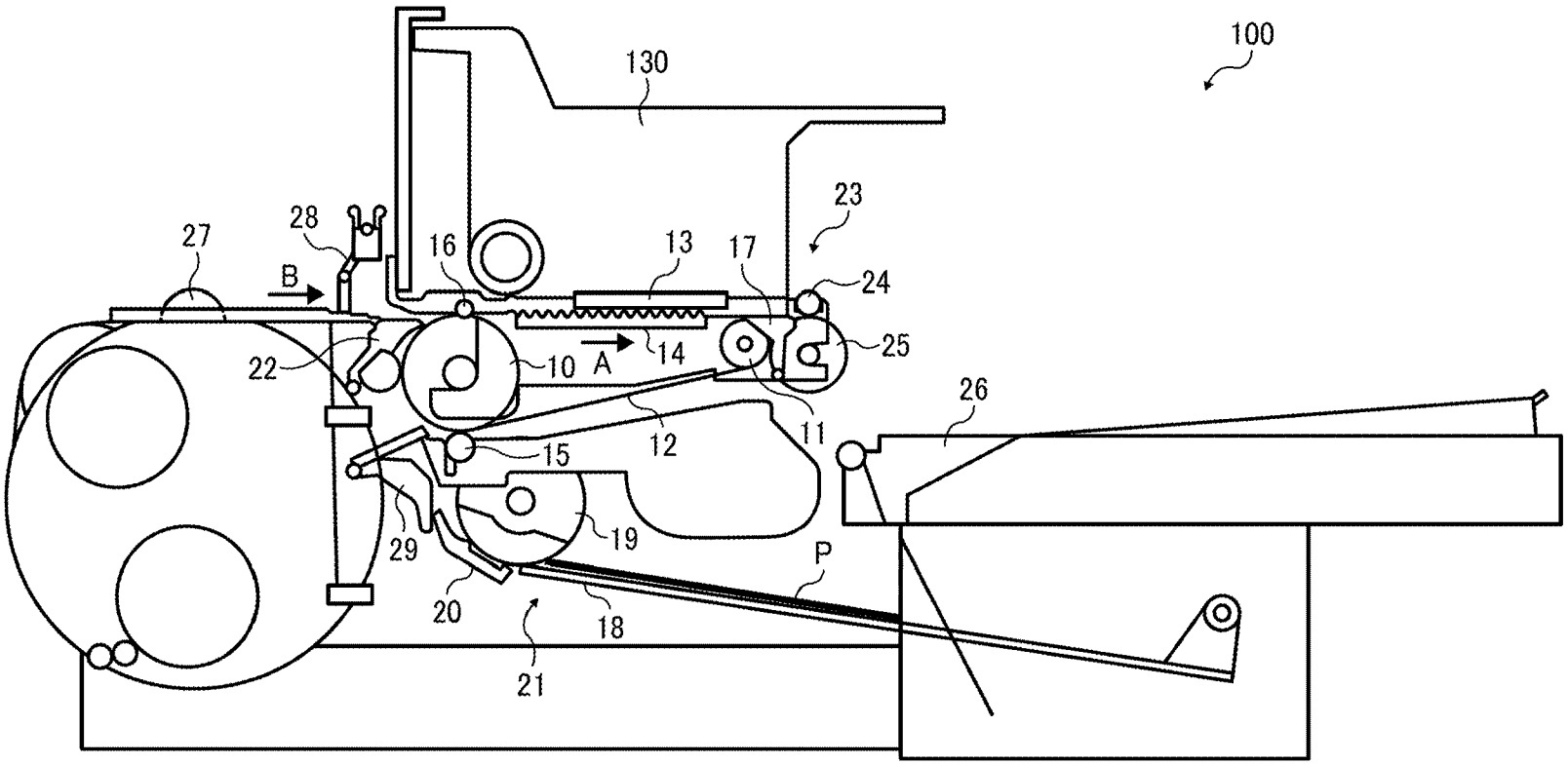
FIG. 1 is a schematic configuration diagram illustrating an image-forming device of an embodiment of a liquid discharge device.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that have the same function, operate in a similar manner, and achieve a similar result.

A configuration according to the present invention will be described below in detail based on an embodiment illustrated in FIGS. 1 to 8.

A liquid discharge device (image-forming device 100) according to the present embodiment includes: a movement driver (main-scanning motor 140) that has a nozzle array disposed in a conveyance direction in which an object (paper P) is conveyed and moves a head to discharge liquid (ink) from the nozzle array (liquid discharge head 13) in a direction (main-scanning direction) perpendicular to the conveyance direction (sub-scanning direction) in a reciprocating manner; a discharge driver (head controller 40) to cause the head to discharge the liquid while the movement driver moves the head; a conveyor (sub-scanning motor 150) that conveys the object while the movement driver moves the head; and a controller (CPU 31) that controls, with respect to discharge of the liquid to a target pixel, on which paths of the head moving in a reciprocating manner (one of forward scan $S_F$ and backward scan $S_B$) to discharge the liquid and from which nozzle in the nozzle array to discharge the liquid based on an amount of conveyance of the object by the conveyor over a period during which the head moves from a predetermined position (start position of operation) to a position where the head can discharge the liquid to the target pixel. Note that terms in the brackets represent symbols and exemplary applications in the embodiment.

Figure 2:
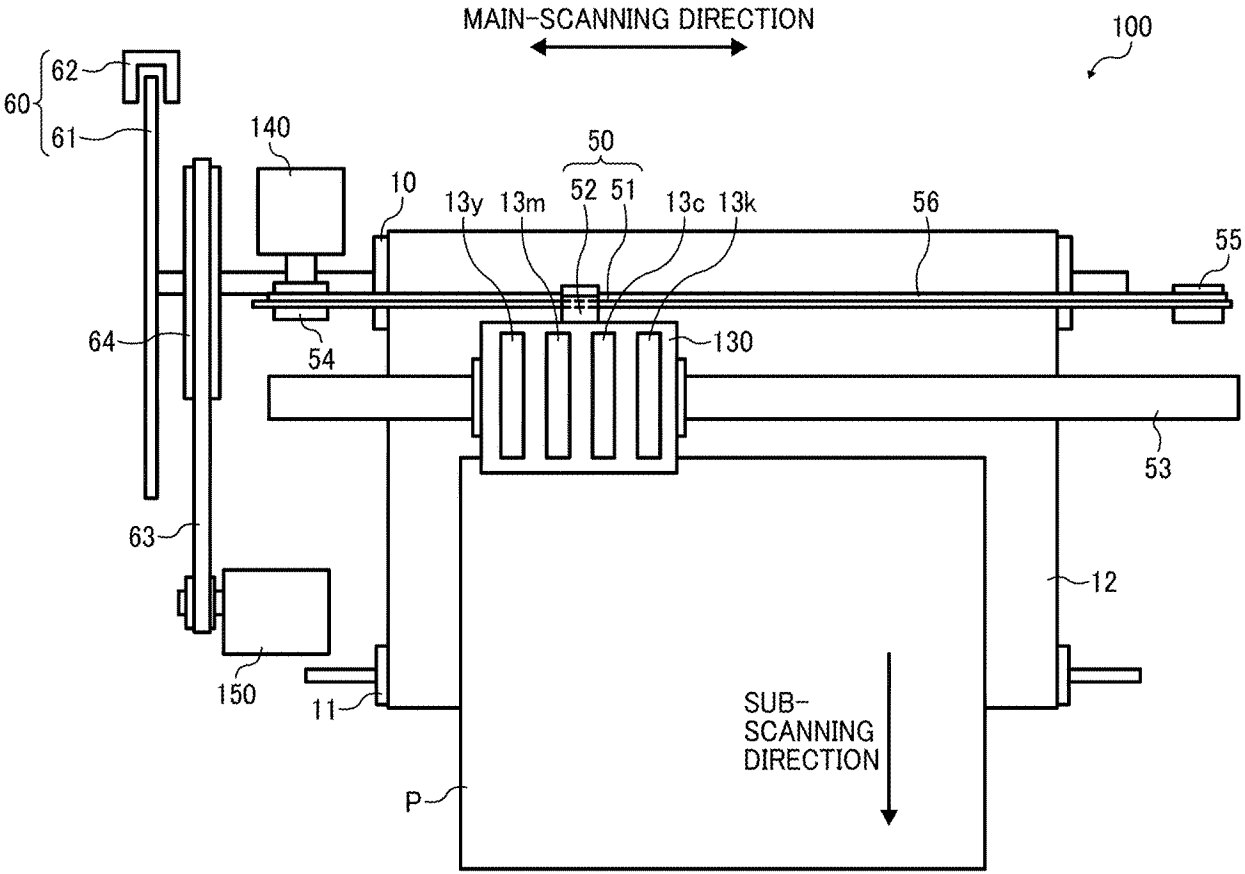
FIG. 2 is a plan view illustrating a configuration of the image-forming device of the embodiment.

FIG. 1 is an explanatory side view illustrating general arrangement of an image-forming device 100 (inkjet recording device) of an embodiment of a liquid discharge device according to the present invention. FIG. 2 is a plan view for illustrating general arrangement of the image-forming device 100 of the embodiment.

(Image-Forming Device)

The image-forming device 100 includes, as a conveyor of a paper P that is a recording medium, a belt-driving roller 10, a tension roller 11, and a charged conveyor belt 12 that is an endless belt wound on these two rollers. The charged conveyor belt 12 may be molded as an endless belt or may be formed into an endless belt by connecting both ends thereof. The charged conveyor belt 12 is formed with an insulating layer on a surface layer thereof for holding electrical charge. The charged conveyor belt 12 conveys the paper P by electrostatic attraction. The belt-driving roller 10 is rotationally driven by a driving system configured by a driving section such as a motor.

The image-forming device 100 includes a liquid discharge head 13 as a recording section to perform recording by discharging ink on the paper P conveyed by the charged conveyor belt 12 and a carriage 130 on which the liquid discharge head 13 is mounted, and moves on the paper P in the main-scanning direction (direction perpendicular to a paper face in FIG. 1) in a reciprocating manner.

As illustrated in FIG. 2, the image-forming device 100 holds the carriage 130 by a guide rod 53 laterally bridged between side plates and moves the carriage 130 by the main-scanning motor 140 for scanning in the main-scanning direction via a timing belt 56 bridged between a driving pulley 54 and a driven pulley 55.

On a rear surface side of the carriage 130, an encoder scale 51 formed with a slit is provided in the main-scanning direction. The carriage 130 is provided with an encoder sensor 52 that detects the slit of the encoder scale 51. The encoder scale 51 and the encoder sensor 52 form a linear encoder 50 that detects a position and the speed of the carriage 130 in the main-scanning direction.

The liquid discharge head 13 discharges ink from a plurality of nozzles formed on an ink discharge surface. The nozzles form a plurality of nozzle arrays arrayed in a direction crossing with the main-scanning direction. In the present embodiment, the liquid discharge heads 13*y*, 13*m*, 13*c*, and 13*k* (also referred to as "liquid discharge head 13" when the colors are not discriminated) that discharge ink droplets of yellow (Y), cyan (C), magenta (M), and black (K), respectively are included.

The image-forming device 100 includes a conveyance guide plate 14 and a charged roller 15 to cause the insulating layer forming the surface layer of the charged conveyor belt 12 to be charged. The conveyance guide plate 14 is positioned between the belt-driving roller 10 and the tension roller 11, disposed inside the charged conveyor belt 12 at a position opposite to the liquid discharge head 13, and serves as a guide member to guide the charged conveyor belt 12 from inside.

The image-forming device 100 includes a conveyance roller 16 on an upstream side of the liquid discharge head 13 in a moving direction A of the charged conveyor belt 12 and a separation claw 17 on a downstream side of the liquid discharge head 13 in the moving direction A of the charged conveyor belt 12. The conveyance roller 16 is disposed in such a manner as to press against the belt-driving roller 10 via the charged conveyor belt 12 to cause the paper P to adhere to the charged conveyor belt 12. The separation claw 17 is disposed in such a manner as to press against the tension roller 11 via the charged conveyor belt 12 to separate the paper P from the charged conveyor belt 12.

As illustrated in FIG. 2, the charged conveyor belt 12 circulates with the belt-driving roller 10 rotationally driven by a sub-scanning motor 150 via a driving belt 63 and a timing roller 64. A shaft of the belt-driving roller 10 is provided with an encoder wheel 61 formed with a slit and a photo sensor 62 of a transmission type to detect the slit of the encoder wheel 61. The encoder wheel 61 and the photo sensor 62 form a wheel encoder 60.

The image-forming device 100 includes a paper-feeding tray 18 mounted with the paper P, a paper-feeding roller 19 to send the paper P from the paper-feeding tray 18, and a separation pad 20 to separate only one sheet of the paper P sent from the paper-feeding roller 19 and to thereby send the paper P. The paper-feeding tray 18, the paper-feeding roller 19, and the separation pad 20 form a paper-feeding unit 21.

The image-forming device 100 includes a guide member 29 and another guide member 22 positioned on the upstream side of the conveyance roller 16 in the moving direction A of the charged conveyor belt 12. The guide member 29 guides, upward substantially in the vertical direction, the paper P separated by the separation pad 20 and thereby sent, that is, the paper P sent from the paper-feeding unit 21. The guide member 22 changes a travelling direction of the paper P guided by the guide member 29 substantially in the vertical direction upward substantially by 90 degrees and then conveys substantially in the horizontal direction between the charged conveyor belt 12 and the conveyance roller 16.

Note that the guide member 22 forms an arc-shaped conveyance path together with the charged conveyor belt 12 wound on the belt-driving roller 10 in order to change direction, substantially by 90 degrees, of the paper P guided upward substantially in the vertical direction. A surface, of the guide member 22, opposite to the charged conveyor belt 12 therefore has an arc shape having a radius of curvature larger than that of the charged conveyor belt 12.

The image-forming device 100 includes a pair of rollers 23 positioned on the downstream side of the liquid discharge head 13 in the moving direction A. The pair of rollers 23 conveys the paper P separated from the charged conveyor belt 12 from the separation claw 17. A cross section of the pair of rollers 23 is illustrated in FIG. 1 as a simple circle. Furthermore, a spur roller 24 having a cross section of a star shape with protrusions on the periphery thereof, a roller 25 abutting against the spur roller 24, and a paper ejection tray 26 to be mounted with the paper P sent by the pair of rollers 23 are included.

The spur roller 24 is engaged with a surface of the paper P on a head side in the downstream side of the liquid discharge head 13 in the moving direction A. When recording is performed on the paper P, including not only a normal paper but also a thick paper such as an overhead projector (OHP) sheet, a card, a postcard, and an envelope, the spur roller 24 simply supports to send the paper P forward. The spur roller 24 and the roller 25 interposing the paper P therebetween, that is, the spur roller 24 engaged with the paper P is not used to define a gap between the paper surface and the liquid discharge head 13.

The image-forming device 100 further includes a manual paper feeder 27 and a manual feeding sensor 28 that detects a tip and a rear end of a recording medium fed from the manual feeder. The manual paper feeder 27 guides the paper P in a direction B substantially horizontally toward an image forming section that performs recoding on a recording medium.

Figure 3:
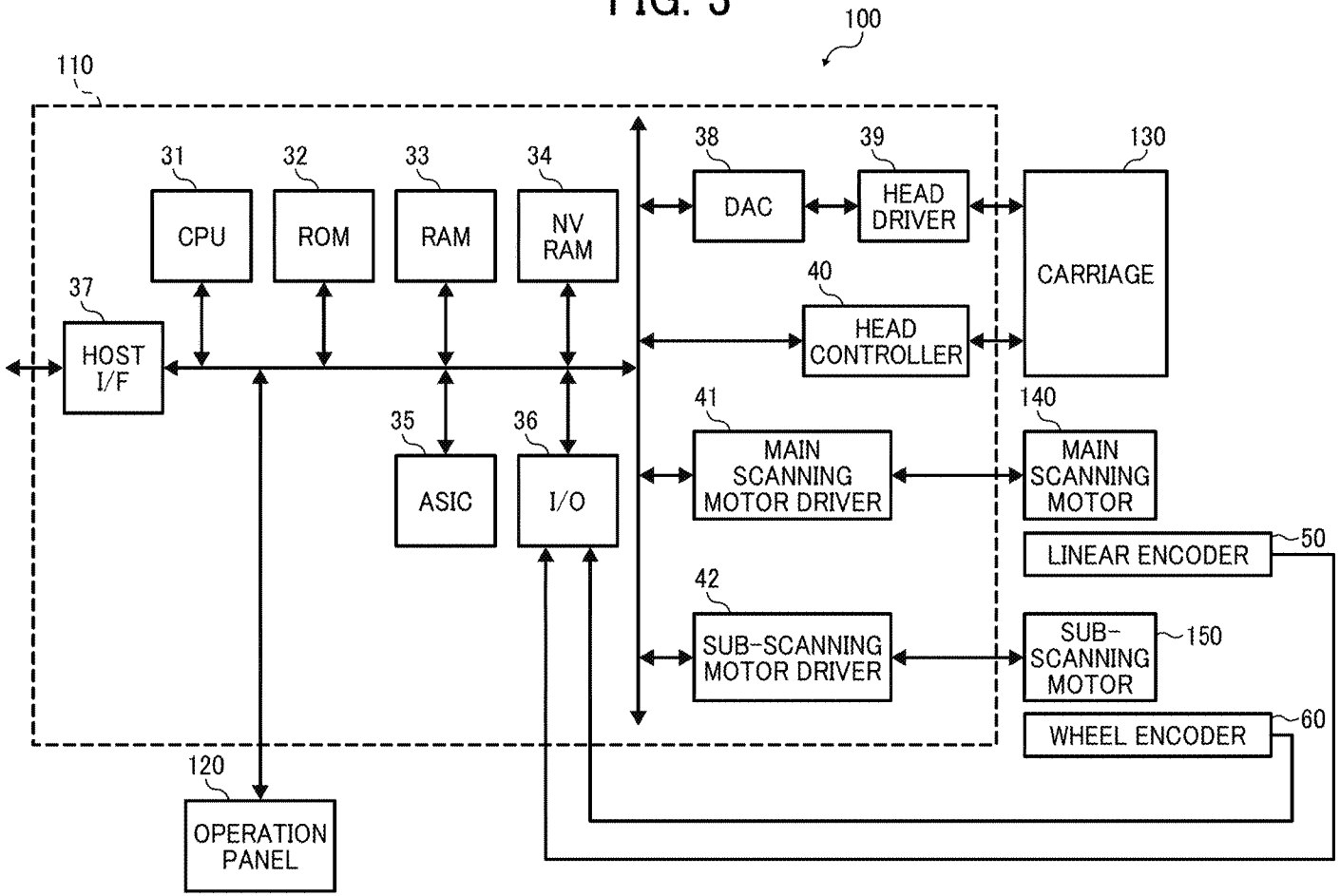
FIG. 3 is a block diagram illustrating general arrangement of the image-forming device of the embodiment.

FIG. 3 is a block diagram illustrating general arrangement of the image-forming device 100. As illustrated in FIG. 3, the image-forming device 100 includes a controller 110, an operation panel 120, the carriage 130, a main-scanning motor 140, the sub-scanning motor 150, the linear encoder 50, and the wheel encoder 60.

The operation panel 120 is a user interface that functions as an operation section and a display for inputting and displaying information for the image-forming device 100. The carriage 130 is mounted with the liquid discharge head 13 that discharges ink as a developer on the paper surface and is moved in the main-scanning direction upon operation of image-forming output.

The main-scanning motor 140 supplies power to move the carriage 130 in the main-scanning direction. The sub-scanning motor 150 supplies power to convey the paper P, which is an object to form an image on, in the sub-scanning direction.

The controller 110 is a control section to control operation of the image-forming device 100. As illustrated in FIG. 3, the controller 110 includes a central processing unit (CPU) 31, a read only memory (ROM) 32, a random access memory (RAM) 33, a nonvolatile RAM (NVRAM) 34, an application specific integrated circuit (ASIC) 35, an I/O 36, a host I/F 37, a digital analogue converter (DAC) 38, a head driver 39, a head controller 40, a main-scanning motor driver 41, and a sub-scanning motor driver 42.

The CPU 31 is an arithmetic section and controls operation of the respective sections of the controller 110. The ROM 32 is a non-volatile storage medium dedicated for reading therefrom and stores a program such as firmware. The RAM 33 is a volatile storage medium capable of reading and writing information at a high speed and is used as a workspace by the CPU 31 for processing information. The NVRAM 34 is a non-volatile storage medium capable of reading and writing information and stores a control program or parameters for control.

The ASIC 35 is a hardware circuit that executes image-processing for image-forming output. The I/O 36 inputs a detection pulse from the linear encoder 50 and the wheel encoder 60 as well as a detection signal from other various sensors. The host I/F 37 is an interface for receiving printing data from a host device such as a personal computer (PC) and employs Ethernet (registered trademark) or universal serial bus (USB) interface.

The DAC 38 converts digital information into an analog signal. The head driver 39 inputs, to the carriage 130, the analog signal converted by the DAC 38 and drives the liquid discharge head 13. The head controller 40 controls the liquid discharge head 13 based on image data to be output for image forming.

The CPU 31 determines a main-scanning position of the carriage 130 based on output from the linear encoder 50 and further determines a sub-scanning position of the carriage 130 based on output from the wheel encoder 60. The CPU 31 controls the main-scanning motor driver 41 and the sub-scanning motor driver 42 based on these.

Each of the main-scanning motor driver 41 and the sub-scanning motor driver 42 is a driving section including a microcomputer. The main-scanning motor driver 41 and the sub-scanning motor driver 42 control driving of the main-scanning motor 140 and the sub-scanning motor 150, respectively, according to control by the CPU 31. That is, the speed of the carriage 130 reciprocating in the main-scanning direction is controlled by driving the main-scanning motor 140 while the conveyance speed of the paper P conveyed in the sub-scanning direction is controlled by driving the sub-scanning motor 150. Note that in the descriptions below the speed of the carriage 130 reciprocating in the main-scanning direction and the conveyance speed of the paper P conveyed in the sub-scanning direction are also referred to as a main-scanning speed and a sub-scanning speed, respectively.

The main-scanning motor driver 41 and the sub-scanning motor driver 42 may be configured by the same microcomputer. In this case, this single microcomputer controls driving of the main-scanning motor 140 and the sub-scanning motor 150.

In the present embodiment, the CPU 31 commands the speed to the main-scanning motor driver 41 and the sub-scanning motor driver 42 for moving the carriage 130 at a constant speed. The main-scanning motor driver 41 and the sub-scanning motor driver 42 drive the main-scanning motor 140 and the sub-scanning motor 150, respectively, according to a profile predetermined for every constant speed.

Alternatively, the CPU 31 may command the speed for moving the carriage 130 at a constant speed or increase or decrease the speed of the carriage 130 to the main-scanning motor driver 41 and the sub-scanning motor driver 42. The main-scanning motor driver 41 and the sub-scanning motor driver 42 may drive the main-scanning motor 140 and the sub-scanning motor 150 based on these.

Printing data from a host side such as an information processing device such as a personal computer, an image reading device such as an image scanner, and an imaging device such as a digital camera is received by the host I/F 37. The CPU 31 reads and analyzes the printing data in a reception buffer included in the host I/F 37, controls the ASIC 35, and executes image processing or rearrangement processing of data for image-forming output. Image data processed by the ASIC 35 is transferred to a head controller 40 by the CPU 31. The CPU 31, the ASIC 35, and other sections of the controller 110 function as an image processor.

Generation of rasterized data for image-forming output may be performed by storing font data in the ROM 32, for example. Alternatively, a printer driver on the host side may deploy the image data into bit map data and this data may be input to the image-forming device 100.

Upon receiving the image data (rasterized data) corresponding to one line of the liquid discharge head 13, the head controller 40 synchronizes this rasterized data of one line with a clock signal, sends to the carriage 130 as serial data, and sends a latch signal to the carriage 130 at predetermined timing.

The DAC 38 reads pattern data of a driving waveform (head driving signal) stored in the ROM 32, generates a driving waveform of an analog signal by performing D/A conversion, and inputs the waveform to the head driver 39. The head driver 39 inputs the driving waveform input from the DAC 38 to the carriage 130.

The carriage 130 includes a shift register, a latch circuit, a level conversion circuit (level shifter), an analog switch array (switch section) and other components. The shift register retains clock signals input from the head controller 40 and the serial data as the image data. The latch circuit latches a register value of the shift register with the latch signal from the head controller 40. The level conversion circuit changes levels of an output value from the latch circuit. The analog switch array is on/off-controlled by the level shifter. The carriage 130 performs on/off control of the analog switch array and thereby selectively applies, to an actuator section of the liquid discharge head 13, a desired driving waveform included in the driving waveform input from the head driver 39 to drive the liquid discharge head 13.

(Oblique Printing)

Oblique printing by the image-forming device 100 will be described.

Figure 4:
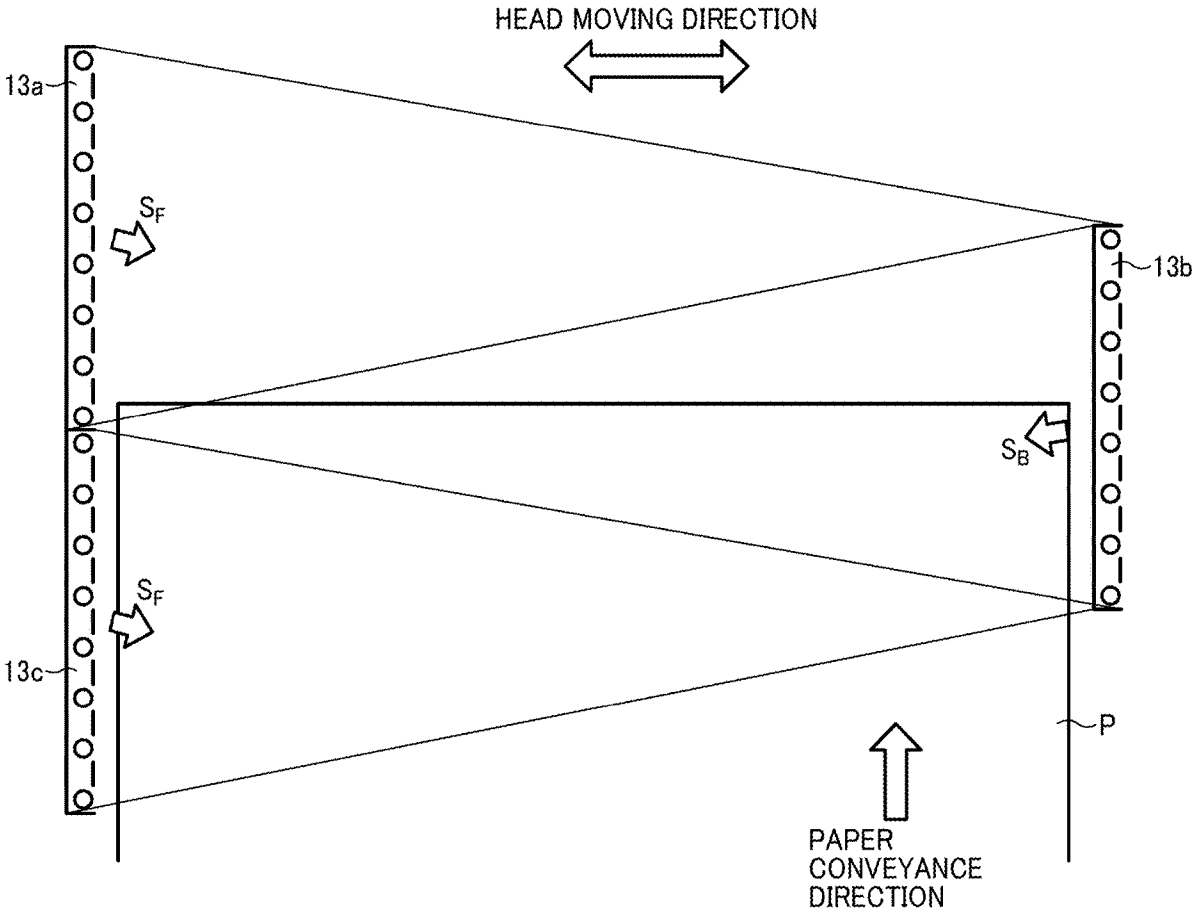
FIG. 4 is an explanatory diagram of a trajectory of a nozzle array in oblique printing of an embodiment.

FIG. 4 is a diagram illustrating a trajectory of the nozzle array upon printing by forward scan $S_F$ (first scan) and backward scan $S_B$ (second scan) with the liquid discharge head 13. The liquid discharge head 13 moves from a position 13*a* to a position 13*b* by the forward scan $S_F$ and then moves from this position to a position 13*c* by the backward scan $S_B$. The forward scan $S_F$ is again performed and thereafter the above is repeated.

In the present embodiment, the example of the liquid discharge head 13 having the nozzle array of one row is described to simplify explanation. The travelling direction of the liquid discharge head 13 and the conveyance direction of the paper P are actually perpendicular to each other. In oblique printing, however, the paper P is kept conveyed even during reciprocating operation of the liquid discharge head 13 and thus relative movement is oblique the trajectory of impacts of discharged dots being oblique as illustrated in FIG. 4.

Figure 5:
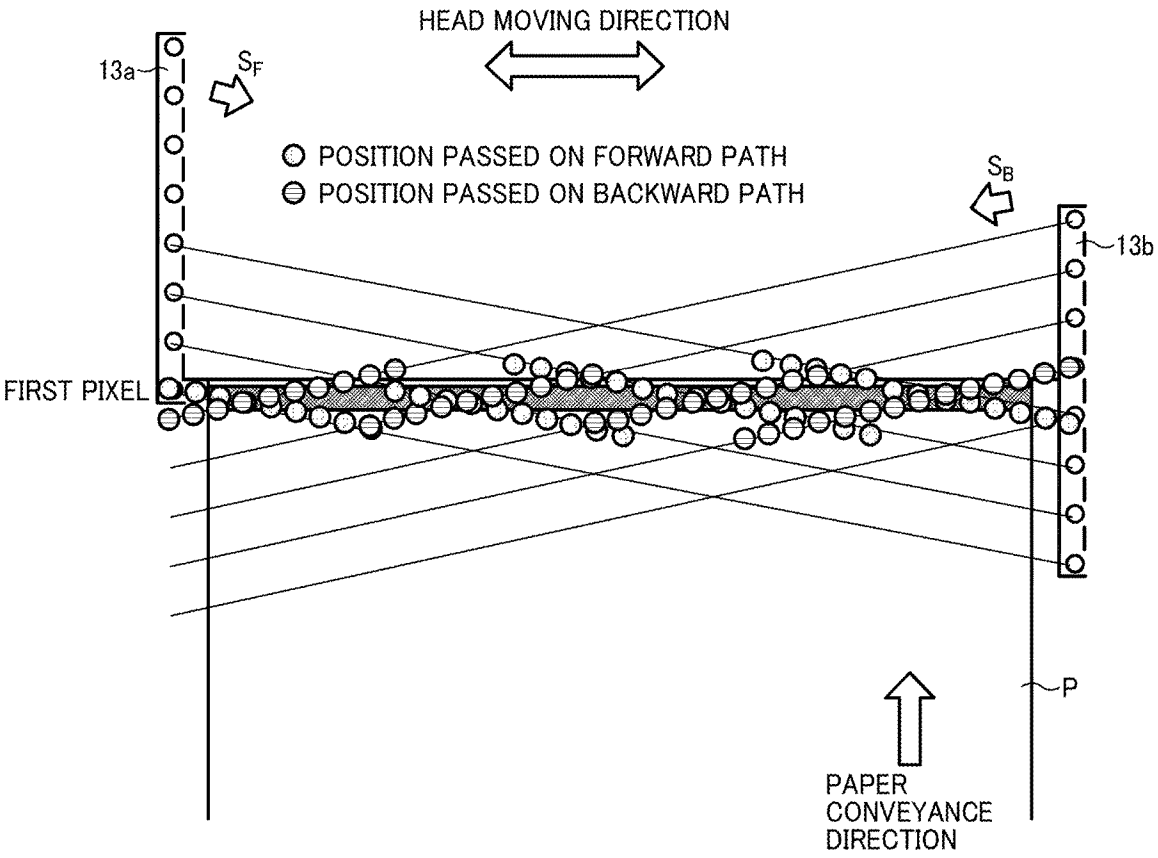
FIG. 5 is an explanatory diagram for the case of printing a line in a main-scanning direction in oblique printing of the embodiment.

FIG. 5 is an explanatory diagram for the case of printing a line (ruled line) in the main-scanning direction in oblique printing. Like FIG. 4, FIG. 5 is also a diagram illustrating a trajectory of the nozzle array upon printing by the forward scan $S_F$ (first scan) and the backward scan $S_B$ (second scan) with the liquid discharge head 13. The liquid discharge head 13 moves from the position 13*a* to the position 13*b* by the forward scan $S_F$ and then performs the backward scan $S_B$ from this position. In FIG. 5, trajectories of four nozzles positioned on an upstream side in the paper conveyance direction with the forward scan $S_F$ as well as trajectories of four nozzles positioned on a downstream side in the paper conveyance direction with the backward scan $S_B$ are also illustrated.

In bidirectional printing, an image is formed on the paper P by forming dots on each of a forward path and a backward path. As illustrated in FIG. 5, when it is desired to print a line at a position corresponding to a first pixel of the paper P in the main-scanning direction, trying to print a line in the main-scanning direction only on one of the forward path and the backward path disadvantageously result in a shaky line at a point where the nozzles are switched. This is because the liquid discharge head 13 moves obliquely relative to the paper P. Moreover, using the nozzles on both of the forward path and the backward path makes a single dotted line a bold wavy image. The shakiness or waviness of the line in the main-scanning direction can be mitigated if a nozzle pitch of the liquid discharge head is sufficiently small. However, a resolution per row of the liquid discharge head is limited (e.g. approximately 150 to 600 dpi) and thus this disadvantage cannot be completely resolved.

In the present embodiment, therefore, nozzles to be used are appropriately switched on the forward path and the backward path as described below. Dots are formed by a nozzle capable of forming the dot at a position near a position originally desired to be formed with the dot, thereby suppressing shakiness or waviness of the line in the main-scanning direction in oblique printing to enhance image quality.

In the present embodiment, the trajectory of movement of the liquid discharge head 13 is illustrated by a straight line for simplicity of description. However, operation of the liquid discharge head 13 actually includes not only a constant speed region where the liquid discharge head 13 moves at a constant speed but also an acceleration region and a deceleration region where the liquid discharge head 13 accelerates or decelerates, respectively, and thus the trajectory is not illustrated by a straight line.

Regarding this, the conveyance speed of the paper P can be controlled not to be completely at a constant speed but be proportional to the main-scanning speed and thereby follow variations in the main-scanning speed. In this manner, relative positions of the liquid discharge head 13 and the paper P can be kept at a certain angle.

The speed of the carriage 130 (main-scanning speed) is controlled by the main-scanning motor driver 41 based on detection by the linear encoder 50 while the conveyance speed of the paper (sub-scanning speed) is controlled by the sub-scanning motor driver 42 based on detection by the wheel encoder 60 as described above. Here, in regions where the main-scanning speed is not constant (acceleration region and deceleration region), the sub-scanning speed is controlled such that the main-scanning speed and the sub-scanning speed are always at a constant ratio.

When the conveyance speed of the paper P is always constant, a trajectory of the liquid discharge head 13 is not linear in the acceleration and the deceleration regions of the main scanning. In this case, impact positions of dots are not at equivalent intervals and thus it is desired to control the liquid discharge head 13 to be at the same speed at least in a region of image formation (liquid discharge region).

In order to move the liquid discharge head 13 at a constant speed in the image formation region, one of controls including enlarging the acceleration and the deceleration regions, increasing acceleration and deceleration speed, and lowering a target value of the constant speed for main scanning and sub-scanning is desired. This results in enlargement of the size of the image-forming device 100 or leads to a decreased printing speed; however, printing control and conveyance control can be simplified.

In the descriptions below, it is assumed that a relative travelling angle of the liquid discharge head 13 and the paper P is maintained at a constant angle on both of a forward path and a backward path by one of the above control when an operational trajectory of the liquid discharge head 13 is not linear.

Figure 6:
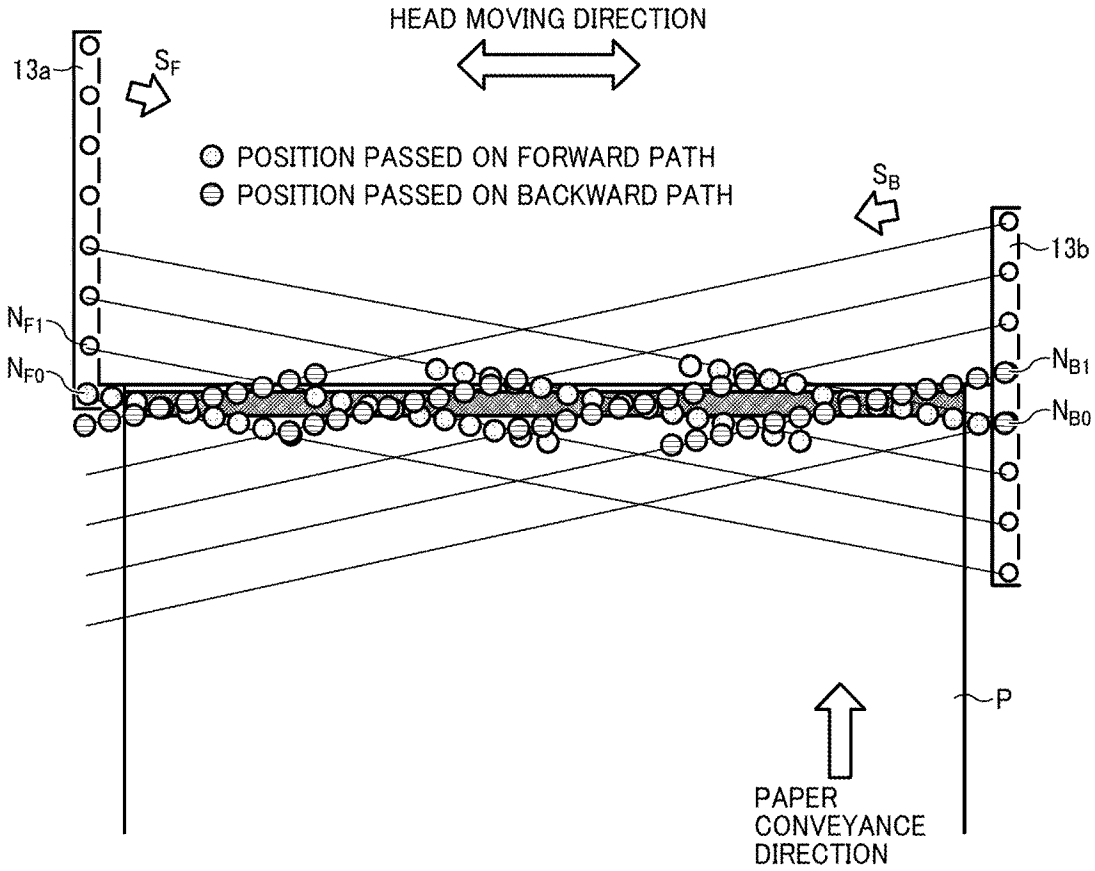
FIG. 6 is another explanatory diagram for the case of printing a line in the main-scanning direction in oblique printing of the embodiment.

Details of nozzle selection control by the image-forming device 100 according to the present invention will be described. FIG. 6 is a diagram of FIG. 5 added with symbols for explanation. As illustrated in FIG. 6, a target nozzle on a forward scan $S_F$ is denoted as $N_{F0}$. Note that illustrated here is a backward scan $S_B$ subsequent to the forward scan $S_F$; however, scanning before the forward scan $S_F$ is also another backward scan $S_B$.

A target nozzle $N_{B0}$ for the backward scan $S_B$ upon initiation of operation of the liquid discharge head 13 for the backward scan $S_B$ (at a time point when the liquid discharge head 13 is at a position 13*b*) is a nozzle positioned on the upstream side in the paper conveyance direction closest to a position of the target nozzle $N_{F0}$ in the paper conveyance direction upon initiation of operation of the forward scan $S_F$ (at a time point when the liquid discharge head 13 is at a position 13*a*).

A nozzle positioned on the downstream side in the paper conveyance direction N nozzles (N=1, 2, 3, . . . , n) apart from the target nozzle $N_{F0}$ of the forward scan $S_F$ is denoted as $N_{FN}$. In FIG. 6, a nozzle $N_{F1}$ positioned on the downstream side in the paper conveyance direction one nozzle apart from the target nozzle $N_{F0}$ is illustrated.

Likewise, a nozzle positioned on the downstream side in the paper conveyance direction N nozzles (N=1, 2, 3, . . . , n) apart from the target nozzle $N_{B0}$ of the backward scan $S_B$ is denoted as $N_{BN}$. In FIG. 6, a nozzle $N_{B1}$ positioned on the downstream side in the paper conveyance direction one nozzle apart from the target nozzle $N_{B0}$ is illustrated.

Here, an amount of paper conveyance from initiation of operation of the forward scan $S_F$ to arrival at a position, where a pixel (target pixel) positioned at a predetermined position X in the main-scanning direction can be formed, is denoted as Y. A quotient and the remainder derived by dividing the paper conveyance amount Y by a nozzle pitch NP are denoted as P and Q, respectively.

Figure 7:
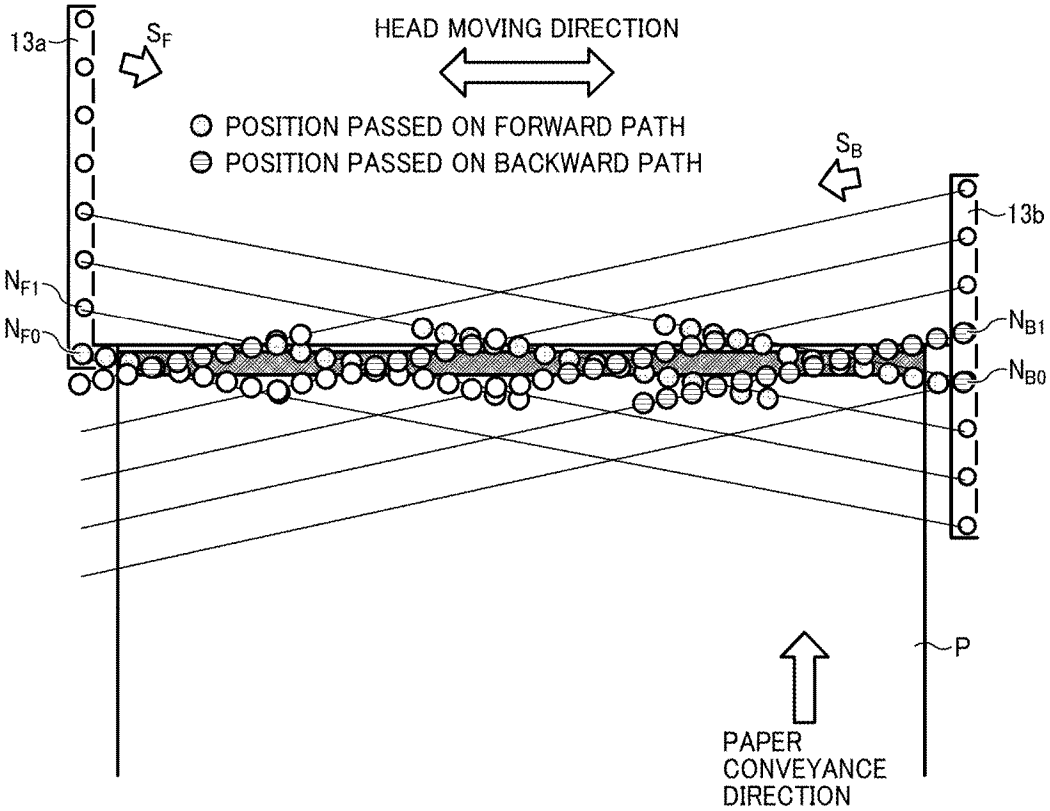
FIG. 7 is an explanatory diagram for the case of printing a line in the main-scanning direction by nozzle selection control of the embodiment.

Here, the pixel positioned at the predetermined position X is formed with dot by one of the following methods (1) to (3) according to the remainder Q. FIG. 7 is an explanatory diagram for the case of printing a line (ruled line) in the main-scanning direction by the nozzle selection control according to the present embodiment. Incidentally, terms "less than" and "more than or equal to" may be replaced with "less than or equal to" and "more than," respectively, in the following conditions (1) to (3).

(1) When the remainder Q is more than or equal to zero and less than one fourth of the nozzle pitch NP, a dot is formed by the nozzle $N_{FP}$ at a position P nozzles apart from the target nozzle $N_{F0}$ on the downstream side in the paper conveyance direction in the forward scan $S_F$.

(2) When the remainder Q is more than or equal to one fourth and less than three fourths of the nozzle pitch NP, a dot is formed by a nozzle $N_{BP}$ at a position P nozzles apart from the target nozzle $N_{B0}$ on the upstream side in the paper conveyance direction in the backward scan $S_B$.

(3) When the remainder Q is more than or equal to three fourths of the nozzle pitch NP and less than the nozzle pitch NP, a dot is formed by a nozzle $N_{FP+1}$ at a position (P+1) nozzles apart from the target nozzle $N_{F0}$ on the downstream side in the paper conveyance direction in the forward scan $S_F$.

As described above, the image data processed by the ASIC 35 is transferred to the head controller 40 by the CPU 31. Generation of rasterized data for image-forming output is performed by the CPU 31, for example.

In the nozzle selection control according to the present embodiment, the CPU 31 controls the head controller 40 based on a calculation result from the ASIC 35. The head controller 40 controls from which nozzle and on which scan the liquid discharge head 13 of the carriage 130 discharges ink. Specifically, control is performed by generating rasterized data with control of whether to form a dot by each of the nozzles in the nozzle array. It is desirable that this conversion control is executed after processing of conversion into data of a bit number allowing the liquid discharge head 13 to discharge.

In the nozzle selection control by the image-forming device 100 according to the present embodiment, discharge from the nozzles is performed by switching nozzles used for discharging ink according to relative positions of the liquid discharge head 13 and the paper P not only among the nozzles in the nozzle array but also among nozzles in different scan operations. This allows for forming dots by a nozzle capable of forming the dot at a position near a position originally desired to be formed with the dot, thereby suppressing shakiness or waviness of the line in the main-scanning direction in oblique printing to enhance quality of the image.

The example of the liquid discharge head 13 having the nozzle array including a single row has been described here; however, it is apparent that the present invention may be applied to a liquid discharge head 13 having a plurality of rows of nozzles. In this case, the nozzle selection control having been described is only required to be performed for each row of the nozzles. The plurality of rows of nozzles may discharge ink of a single color or may discharge ink of two or more different colors.

Figure 8:
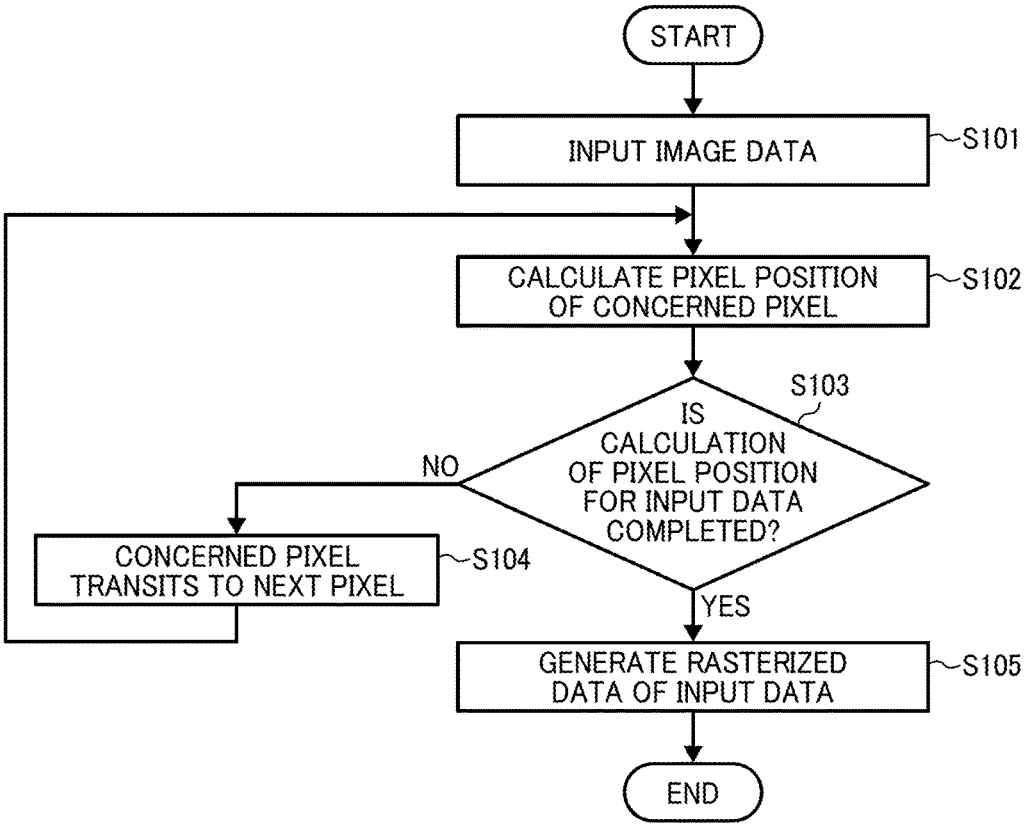
FIG. 8 is a flowchart illustrating exemplary processing to generate rasterized data.

FIG. 8 is a flowchart illustrating exemplary processing of generating the rasterized data. When image data is input to the CPU 31 (S101), the CPU 31 calculates a pixel position for each target pixel such that ink is discharged from a predetermined nozzle (S102). The calculation is performed by the method described above with FIG. 6.

The ROM 32 pre-stores, for each pixel, the paper conveyance amount from initiation of conveyance. The ROM 32 also store a nozzle pitch. Although the paper conveyance amount is different for each mode, the ROM 32 also stores the paper conveyance amount for each mode. Based on these pieces of information, the CPU 31 calculates a pixel position for each pixel in the rasterized data and stores the result in the RAM 33.

Next, whether calculation of the pixel position for input data is completed is determined (S103). When this is not completed (No in S103), the flow transfers to processing of a next pixel (S104). The CPU 31 performs calculation processing of a pixel position for the input image data (Yes in S103), and then generates rasterized data based on the calculation result (S105).

In the above example, the whole image data is processed. When an image of a band shape can be formed with output image data having a predetermined sub-scanning width, the flow may include generation and output of rasterized data of the image of the band shape. In this case, subsequent processing can be initiated promptly.

Note that this processing may not be performed by the CPU 31 in the image-forming device 100 and may instead be implemented as a function of a printer driver in a host device such as a PC. Alternatively, this processing may be performed not by the CPU 31 but as a function of the ASIC 35. In the flow above, the rasterized data is generated; however, rearrangement into data of a bit number that can be discharged by the liquid discharge head 13 may be performed for output. In this case, input image data is rasterized data and thus output data may be of a bit number that can be discharged by the liquid discharge head 13. Alternatively, the rasterized data may be converted into data of a bit number that can be discharged by the liquid discharge head 13 and calculation may be performed thereafter. Then rearranged data may be output.

The nozzle selection control and the image processing by the image-forming device 100 may be executed by a program (control program of the liquid discharge device). Preferably, a printer driver executes the program. The program may be downloaded from the Internet, for example. Alternatively, the program may be recorded in a recording medium in a manner executable by the image-forming device 100.

The above embodiments are preferable exemplary embodiments of the present invention and thus the present invention is not limited thereto and may include various modifications within a scope not departing from the principal of the present invention.

For example in the present application, a "liquid discharge device" includes a liquid discharge head and drives the liquid discharge head to discharge liquid. The liquid discharge device includes not only a device capable of discharging liquid to an object to which the liquid can adhere but also a device that discharges the liquid into gas or liquid.

This "liquid discharge device" may also include a section related to feeding, conveyance, or ejection of an object to which the liquid can adhere, a pre-processing device, a post-processing device, or other devices.

Examples of a "liquid discharge device" include an image-forming device that forms an image by discharging ink on a paper and a three-dimensional shaping apparatus that discharges shaping liquid to a powder layer that is formed by powder into a layer shape in order to shape a three-dimensional shaped object.

A "liquid discharge device" is not limited to a device that visualizes a significant image such as a letter and a graphic by discharged liquid and includes a device that forms a pattern or another object, which is meaningless by itself, and a device that shapes a three-dimensional object.

The aforementioned "object to which the liquid can adhere" includes an object to which liquid can adhere at least temporarily and keeps adhering thereto or permeates thereafter. Specific examples include a recording medium such as a paper, a recording paper, a printing paper, a film, and a piece of cloth, an electronic component such as an electronic substrate and a piezoelectric element, and a medium such as a powder layer, an internal organ model, and a test cell. The "object to which the liquid can adhere" includes all objects to which liquid adheres unless specifically limited.

A material of the "object to which the liquid can adhere" is not limited as long as the liquid can adhere even temporarily such as a paper, string, fiber, cloth, leather, metal, plastic, glass, wood, and ceramics.

The "liquid" is not specifically limited as long as it has viscosity or surface tension that can be discharged from a head. Preferably, the "liquid" has a viscosity of 30 mPa/s or less at a normal temperature under normal pressure or by heating or cooling. More specifically, the "liquid" is a solution, suspension, or emulsion containing a solvent such as water or an organic solvent, a colorant such as a dye or pigment, a function providing material such as a polymerizable compound, resin, and a surfactant, a biocompatible material such as DNA, amino acid, protein, and calcium, or edible material such as natural dye. These may be used for ink for ink jet, surface-processing liquid, liquid for forming a component of an electronic element or a light-emitting element or an electronic circuit resist pattern, liquid material for three-dimensional shaping, or other usage.

Other examples of the "liquid discharge device" include a process liquid applicator, which discharges process liquid on a paper in order to apply the process liquid on a surface of the paper with an object to improve the quality of the surface of the paper, and an injection granulator, which granulates fine particles of a raw material by injecting, via a nozzle, composition liquid where a raw material is dispersed in a solution.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A liquid discharge device, comprising:

a liquid discharge head;

a nozzle array on the liquid discharge head in a conveyance direction in which an object is conveyed;

a movement driver configured to move the liquid discharge head to discharge a liquid from the nozzle array in a direction perpendicular to the conveyance direction in a reciprocating manner;

a discharge driver configured to instruct the liquid discharge head to discharge the liquid while the movement driver moves the liquid discharge head;

a conveyor configured to convey the object while the movement driver moves the liquid discharge head; and a controller configured to control discharge of the liquid to a target pixel by, setting a moving speed of the liquid discharge head by the movement driver and a conveyance speed of the object by the conveyor such that the moving speed remains proportional to the conveyance speed in response to either an acceleration and a deceleration the liquid discharge head, and determining on which reciprocating travelling of the liquid discharge head to discharge the liquid to the target pixel, and from which nozzle in the nozzle array to discharge the liquid to the target pixel, based on an amount of conveyance of the object by the conveyor over a period during which the liquid discharge head moves from a predetermined position to a position where the liquid discharge head is to discharge the liquid to the target pixel.

2. The liquid discharge device according to claim 1, wherein a target nozzle for forward travelling $S_F$ of the liquid discharge head is denoted as $N_{F0}$ and preceding and subsequent backward travelling to the forward travelling $S_F$ are denoted as $S_B$, a nozzle positioned, upon initiation of operation of backward travelling $S_B$ of the liquid discharge head, on an upstream side in the conveyance direction closest to a position of the target nozzle $N_{F0}$ in the conveyance direction upon initiation of operation of the forward travelling $S_F$ of the liquid discharge head is regarded as a target nozzle $N_{B0}$ for the backward travelling $S_B$, an amount of conveyance of the object by the conveyor, from initiation of operation of the forward travelling $S_F$ to arrival at a position, where the liquid can be discharged to the target pixel, is denoted as Y, a quotient and a remainder derived by dividing the amount of conveyance Y by a nozzle pitch NP are denoted as P and Q, respectively, and the controller controls on which reciprocating travelling of the liquid discharge head to discharge the liquid and from which nozzle in the nozzle array to discharge the liquid according to a value of the remainder Q.

3. The liquid discharge device according to claim 2, wherein the controller forms a dot of the target pixel by a nozzle $N_{FP}$ at a position P nozzles apart from the target nozzle $N_{F0}$ on a downstream side in the conveyance direction on the forward travelling $S_F$ when the remainder Q is more than or equal to zero and less than one fourth of the nozzle pitch NP, the controller forms the dot of the target pixel by a nozzle $N_{BP}$ at a position P nozzles apart from the target nozzle $N_{B0}$ on the upstream side in the conveyance direction in the backward travelling $S_B$ when the remainder Q is more than or equal to one fourth and less than three fourths of the nozzle pitch NP, and the controller forms the dot of the target pixel by a nozzle $N_{FP+1}$ at a position (P+1) nozzles apart from the target nozzle $N_{F0}$ on the downstream side in the conveyance direction on the forward travelling $S_F$ when the remainder Q is more than or equal to three fourths of the nozzle pitch NP and less than the nozzle pitch NP.

4. The liquid discharge device according to claim 1, wherein the conveyor conveys the object at a constant speed, and the movement driver moves the liquid discharge head at a constant speed at least in a region where the liquid discharge head discharges the liquid.

5. The liquid discharge device according to claim 1, wherein the controller is configured to control the moving speed of the liquid discharge head by the movement driver and the conveyance speed of the object by the conveyor such that the moving speed and the conveyance speed are proportional to each other in both of a region of acceleration and deceleration where the liquid discharge head is either accelerated or decelerated and a region of constant speed where the liquid discharge head moves at a constant speed.

6. The liquid discharge device according to claim 1, wherein the controller changes image data based on a determination as to whether to form a dot with each of the nozzles in the nozzle array.

7. The liquid discharge device according to claim 6, wherein the controller performs processing of conversion into data of a bit number allowing the liquid discharge head to discharge and then changes the data of the bit number based on the determination as to whether to form a dot with each of the nozzles in the nozzle array.

8. The liquid discharge device according to claim 1, wherein the liquid discharge head comprises a plurality of rows of the nozzles, and the controller performs the control for each of the rows of the nozzles.

9. The liquid discharge device according to claim 1, wherein the controller is configured to discharge the liquid onto the object during an oblique printing operation by controlling the discharge driver to instruct the liquid discharge head to discharge the liquid while the movement driver moves the liquid discharge head such that the liquid is discharged onto the object without halting conveyance of the object.

10. The liquid discharge device according to claim 1, wherein the controller is configured to control on which reciprocating travelling of the liquid discharge head to discharge the liquid and from which nozzle in the nozzle array to discharge the liquid according to a remainder Q derived by dividing an amount of conveyance Y of the object by a nozzle pitch NP of the nozzle array.

11. A liquid discharge control method, performed by a liquid discharge device, the liquid discharge device including a nozzle array, a movement driver, a discharge driver, and a conveyor, the nozzle array being disposed in a conveyance direction in which an object is conveyed, the movement driver configured to move a head to discharge a liquid from the nozzle array in a direction perpendicular to the conveyance direction in a reciprocating manner, the discharge driver configured to instruct the head to discharge the liquid while the movement driver moves the head and, the conveyor configured to convey the object while the movement driver moves the head, the method comprising:

setting a moving speed of the head by the movement driver and a conveyance speed of the object by the conveyor such that the moving speed remains proportional to the conveyance speed in response to either an acceleration and a deceleration the head;

determining on which reciprocating travelling of the head to discharge the liquid to a target pixel based on an amount of conveyance of the object by the conveyor over a period during which the head moves from a predetermined position to a position where the head is to discharge the liquid to the target pixel; and determining from which nozzle in the nozzle array to discharge the liquid to the target pixel based on the amount of conveyance of the object by the conveyor over the period.

12. The liquid discharge control method according to claim 11, wherein a target nozzle for forward travelling $S_F$ of the head is denoted as $N_{F0}$ and preceding and subsequent backward travelling to the forward travelling $S_F$ are denoted as $S_B$, a nozzle positioned, upon initiation of operation of the backward travelling $S_B$ of the head, on an upstream side in the conveyance direction closest to a position of the target nozzle $N_{F0}$ in the conveyance direction upon initiation of operation of the forward travelling $S_F$ of the head is regarded as a target nozzle $N_{B0}$ for the backward travelling $S_B$, an amount of conveyance of the object by the conveyor, from initiation of operation of the forward travelling $S_F$ to arrival at a position, where the liquid can be discharged to the target pixel, is denoted as Y, a quotient and a remainder derived by dividing the amount of conveyance Y by a nozzle pitch NP are denoted as P and Q, respectively, and wherein the determining on which reciprocating travelling and from which nozzle in the nozzle array to discharge the liquid to the target pixel is based on a value of the remainder Q.

13. The liquid discharge control method according to claim 11, further comprising:

discharging the liquid onto the object during an oblique printing operation by controlling the discharge driver to instruct the head to discharge the liquid while the movement driver moves the head such that the liquid is discharged onto the object without halting conveyance of the object.

14. The liquid discharge control method according to claim 11, further comprising:

deriving a remainder Q by dividing an amount of conveyance Y of the object by a nozzle pitch NP of the nozzle array, wherein the determining on which reciprocating travelling and from which nozzle in the nozzle array to discharge the liquid to the target pixel is based on the remainder Q.

15. A non-transitory computer-readable medium storing computer-executable instructions which, when executed by a processor, perform a liquid discharge control method performed by a liquid discharge device, the liquid discharge device including a nozzle array, a movement driver, a discharge driver, and a conveyor, the nozzle array being disposed in a conveyance direction in which an object is conveyed, the movement driver configured to move a head to discharge a liquid from the nozzle array in a direction perpendicular to the conveyance direction in a reciprocating manner, the discharge driver configured to instruct the head to discharge the liquid while the movement driver moves the head and, the conveyor configured to convey the object while the movement driver moves the head, the method comprising:

setting a moving speed of the head by the movement driver and a conveyance speed of the object by the conveyor such that the moving speed remains proportional to the conveyance speed in response to either an acceleration and a deceleration the head;

determining on which reciprocating travelling of the head to discharge the liquid to a target pixel based on an amount of conveyance of the object by the conveyor over a period during which the head moves from a predetermined position to a position where the head is to discharge the liquid to the target pixel; and determining from which nozzle in the nozzle array to discharge the liquid to the target pixel based on the amount of conveyance of the object by the conveyor over the period.

16. The non-transitory computer-readable medium according to claim 15, wherein a target nozzle for forward travelling $S_F$ of the head is denoted as $N_{F0}$ and preceding and subsequent backward travelling to the forward travelling $S_F$ are denoted as $S_B$, a nozzle positioned, upon initiation of operation of the backward travelling $S_B$ of the head, on an upstream side in the conveyance direction closest to a position of the target nozzle $N_{F0}$ in the conveyance direction upon initiation of operation of the forward travelling $S_F$ of the head is regarded as a target nozzle $N_{B0}$ for the backward travelling $S_B$, an amount of conveyance of the object by the conveyor, from initiation of operation of the forward travelling $S_F$ to arrival at a position, where the liquid can be discharged to the target pixel, is denoted as Y, a quotient and a remainder derived by dividing the amount of conveyance Y by a nozzle pitch NP are denoted as P and Q, respectively, and wherein the determining on which reciprocating travelling and from which nozzle in the nozzle array to discharge the liquid to the target pixel is based on a value of the remainder Q.

17. The non-transitory computer-readable medium according to claim 15, wherein the computer-executable instructions, when executed by the processor, further configure the processor to, discharge the liquid onto the object during an oblique printing operation by controlling the discharge driver to instruct the head to discharge the liquid while the movement driver moves the head such that the liquid is discharged onto the object without halting conveyance of the object.

18. The non-transitory computer-readable medium according to claim 15, wherein the computer-executable instructions, when executed by the processor, further configure the processor to, derive a remainder Q by dividing an amount of conveyance Y of the object by a nozzle pitch NP of the nozzle array, and determine on which reciprocating travelling and from which nozzle in the nozzle array to discharge the liquid to the target pixel is based on the remainder Q.

19. A liquid discharge device, comprising:

a liquid discharge head;

a nozzle array on the liquid discharge head in a conveyance direction in which an object is conveyed;

a movement driver configured to move the liquid discharge head to discharge a liquid from the nozzle array in a direction perpendicular to the conveyance direction in a reciprocating manner;

a discharge driver configured to instruct the liquid discharge head to discharge the liquid while the movement driver moves the liquid discharge head;

a conveyor configured to convey the object while the movement driver moves the liquid discharge head; and a controller configured to control discharge of the liquid to a target pixel, wherein an amount of conveyance of the object by the conveyor, from initiation of operation of a forward travelling $S_F$ to arrival at a position where the liquid can be discharged to a target pixel, is denoted as Y, a quotient and a remainder derived by dividing the amount of conveyance Y by a nozzle pitch NP are denoted as P and Q, respectively, and the controller is configured to control on which reciprocating travelling of the liquid discharge head to discharge the liquid and from which nozzle in the nozzle array to discharge the liquid according to a value of the remainder Q.

20. The liquid discharge device according to claim 19, wherein a target nozzle for the forward travelling $S_F$ of the liquid discharge head is denoted as $N_{F0}$ and preceding and subsequent backward travelling to the forward travelling $S_F$ are denoted as $S_B$, a nozzle positioned, upon initiation of operation of backward travelling $S_B$ of the liquid discharge head, on an upstream side in the conveyance direction closest to a position of the target nozzle $N_{F0}$ in the conveyance direction upon initiation of operation of the forward travelling $S_F$ of the liquid discharge head is regarded as a target nozzle $N_{B0}$ for the backward travelling $S_B$, the controller forms a dot of the target pixel by a nozzle $N_{FP}$ at a position P nozzles apart from the target nozzle $N_{F0}$ on a downstream side in the conveyance direction on the forward travelling $S_F$ when the remainder Q is more than or equal to zero and less than one fourth of the nozzle pitch NP, the controller forms the dot of the target pixel by a nozzle $N_{BP}$ at a position P nozzles apart from the target nozzle $N_{B0}$ on the upstream side in the conveyance direction in the backward travelling $S_B$ when the remainder Q is more than or equal to one fourth and less than three fourths of the nozzle pitch NP, and the controller forms the dot of the target pixel by a nozzle $N_{FP+1}$ at a position (P+1) nozzles apart from the target nozzle $N_{F0}$ on the downstream side in the conveyance direction on the forward travelling $S_F$ when the remainder Q is more than or equal to three fourths of the nozzle pitch NP and less than the nozzle pitch NP.

* * * * *